US007473857B2

(12) United States Patent
Chou

(10) Patent No.: US 7,473,857 B2
(45) Date of Patent: Jan. 6, 2009

(54) SWITCH HAVING A ROLLING CONDUCTIVE BALL

(76) Inventor: Tien-Ming Chou, No. 41, San-Hsi 5th St., Taichung City (TW)

( * ) Notice: Subject to any disclaimer, the term of this patent is extended or adjusted under 35 U.S.C. 154(b) by 265 days.

(21) Appl. No.: 11/492,419

(22) Filed: Jul. 25, 2006

(65) Prior Publication Data

US 2008/0024956 A1 Jan. 31, 2008

(51) Int. Cl.
*H01H 35/02* (2006.01)

(52) U.S. Cl. ..... 200/61.45 R; 200/61.52

(58) Field of Classification Search ..... 200/61.43, 200/61.44, 61.45 R, 61.46–61.53, 276, 277
See application file for complete search history.

(56) References Cited

U.S. PATENT DOCUMENTS 4,467,154 A * 8/1984 Hill ..... 200/61.45 R
5,136,126 A * 8/1992 Blair ..... 200/61.52
5,672,856 A * 9/1997 Kolb et al. ..... 200/61.52
5,965,855 A * 10/1999 Tanazawa et al. .... 200/61.45 M
6,115,929 A * 9/2000 Tanazawa et al. ..... 33/366.24
6,706,979 B1 * 3/2004 Chou ..... 200/61.45 R
7,045,724 B1 5/2006 Chou

* cited by examiner

*Primary Examiner*—Elvin G Enad
*Assistant Examiner*—Marina Fishman
(74) *Attorney, Agent, or Firm*—Frommer Lawrence & Haug LLP; Ronald R. Santucci

(57) ABSTRACT

A switch includes a housing defining bottom and top receiving grooves and a chamber, and a plurality of angularly spaced apart terminal rods mounted on the housing. The terminal rods have top and bottom end portions disposed around the top and bottom receiving grooves, respectively. Each terminal rod further has spaced-apart top and bottom transverse flanges disposed between the receiving grooves. The conductive ball is movable from the chamber to the top or bottom receiving groove and vice versa. The conductive ball contacts two adjacent ones of the terminal rods by bridging the top and bottom transverse flanges of the corresponding two terminal rods when the switch is in an ON position, and moves into the top or bottom receiving groove when the switch is in an OFF position.

7 Claims, 18 Drawing Sheets

SWITCH HAVING A ROLLING CONDUCTIVE BALL

BACKGROUND OF THE INVENTION

1. Field of the Invention

The invention relates to a switch, more particularly to a switch that has a rolling conductive ball and that is suitable for mounting on a circuit board for providing triggering signals.

2. Description of the Related Art

Referring to FIGS. 1 to 4, a jerk-initiated switch 1, as disclosed in U.S. Pat. No. 7,045,724, is shown to comprise a housing 6, four electric terminal rods 8, and an electrically conductive ball 9.

The housing defines a chamber 65 that has upper and lower tapered portions 652, 651.

Each of the electric terminal rods 8 includes top and bottom end portions 83, 82 received in a respective mounting hole 713 and a respective through hole 613 formed in the housing 6, and a flange 71 between the top and bottom end portions 83, 82.

The electrically conductive ball 9 is disposed in the housing, and is rollable within the chamber 65.

When the switch 1 is in an OFF state, the conductive ball 9 rests in the lower tapered portion 651, and is not in contact with any of the terminal rods 8. When the switch 1 is tilted at 45 degrees, as shown in FIG. 4, the conductive ball 9 rolls to contact the flanges 71 of any two adjacent ones of the terminal rods 8, thereby switching the switch 1 to an ON state.

While the switch 1 can be set to an ON or OFF state by changing the position of the same, the switch 1 cannot be placed in the ON state constantly by rotating the switch 1 continuously about an axis parallel to the terminal rods 8 because the conductive ball 9 tends to move into the upper or lower tapered portion 652, 651 of the chamber 65 from the flanges 71 during rotation.

Moreover, electronic products, such as digital cameras, PDAs, cellular phones, electronic toys, etc., are increasingly being provided with a large number of functions. Consequences of this include the need for circuit boards to be able to provide triggering signals, as well as a high demand for quality.

SUMMARY OF THE INVENTION

Therefore, the object of the present invention is to provide a switch that has a high sensitivity and that is suitable for use on a circuit board for providing triggering signals.

According to this invention, a switch comprises a housing, a plurality of terminal rods, and a conductive ball. The housing defines a bottom receiving groove, a top receiving groove, and a chamber between the top and bottom receiving grooves. Each of the top and bottom receiving grooves is defined by a truncated cone-shaped wall, and a groove bottom connected to the truncated cone-shaped wall. The truncated cone-shaped walls of the top and bottom receiving grooves define a co-axis that passes through the chamber. The terminal rods are mounted on the housing around the co-axis in an angularly spaced apart manner, and extend through the chamber. The terminal rods have top end portions disposed around the top receiving groove, and bottom end portions disposed around the bottom receiving groove. Each of the terminal rods further has spaced-apart top and bottom transverse flanges disposed between the top and bottom receiving grooves. The conductive ball is disposed inside the housing, and is movable from the chamber to the top or bottom receiving groove and vice versa. The conductive ball contacts two adjacent ones of the terminal rods by bridging the top and bottom transverse flanges of said two adjacent ones of the terminal rods when the switch is in an ON position, and moves into the top or bottom receiving groove when the switch is in an OFF position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
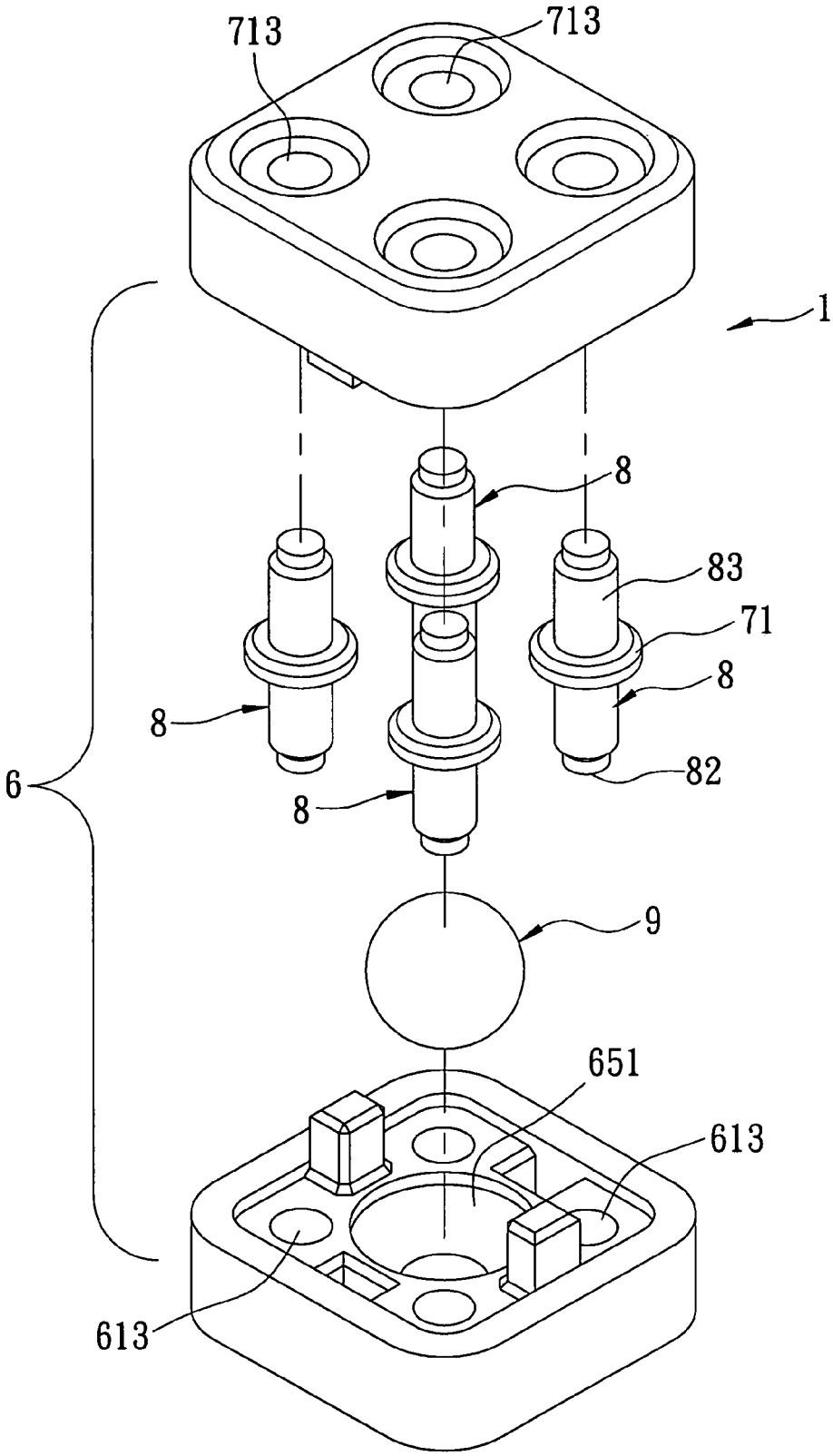
FIG. 1 PRIOR ART
FIG. 1 is an exploded perspective view of a jerk-initiated switch disclosed in U.S. Pat. No. 7,045,724.
Figure 2:
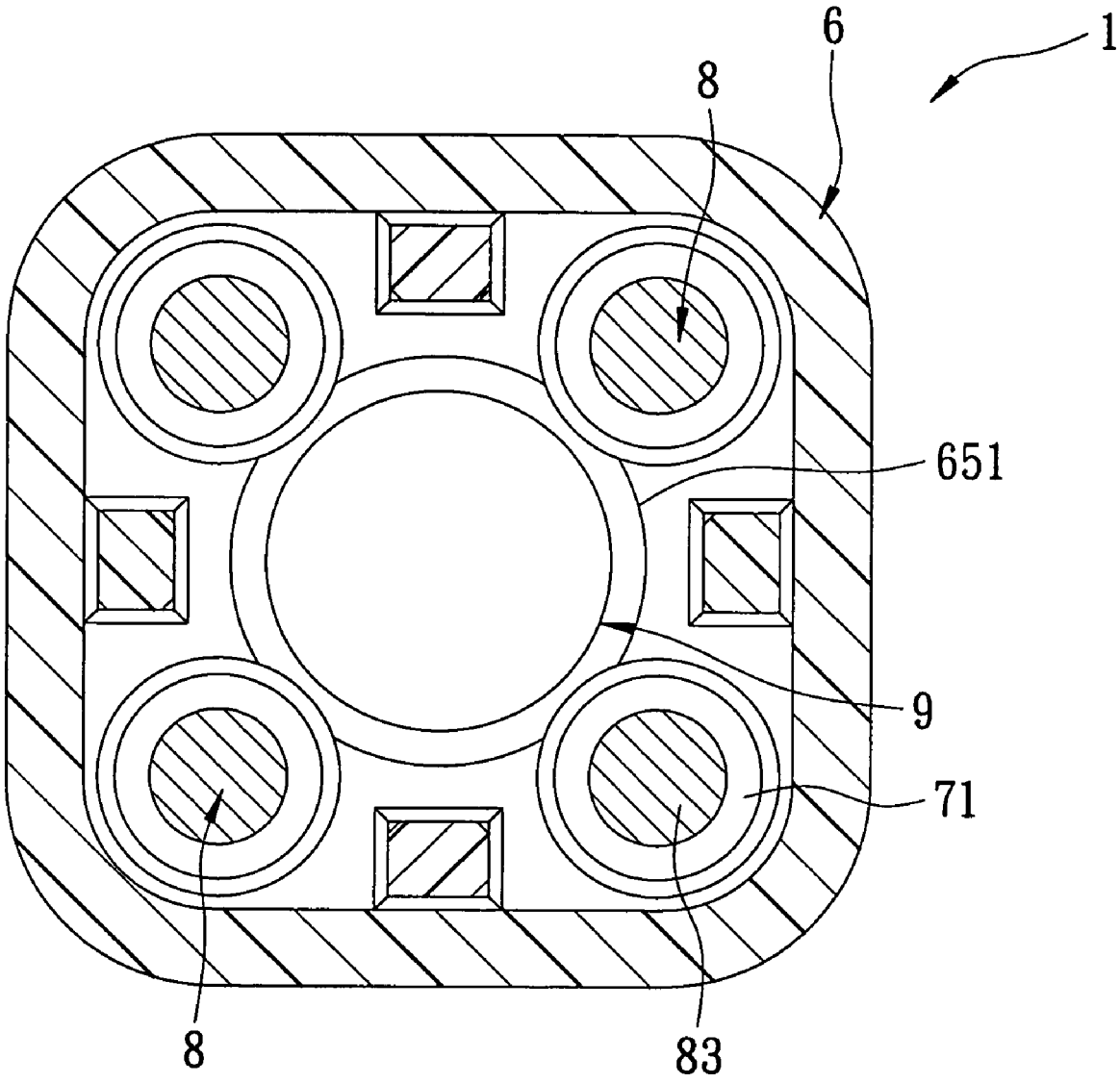
FIG. 2 PRIOR ART
FIG. 2 is a top plan view of FIG. 1.
Figure 3:
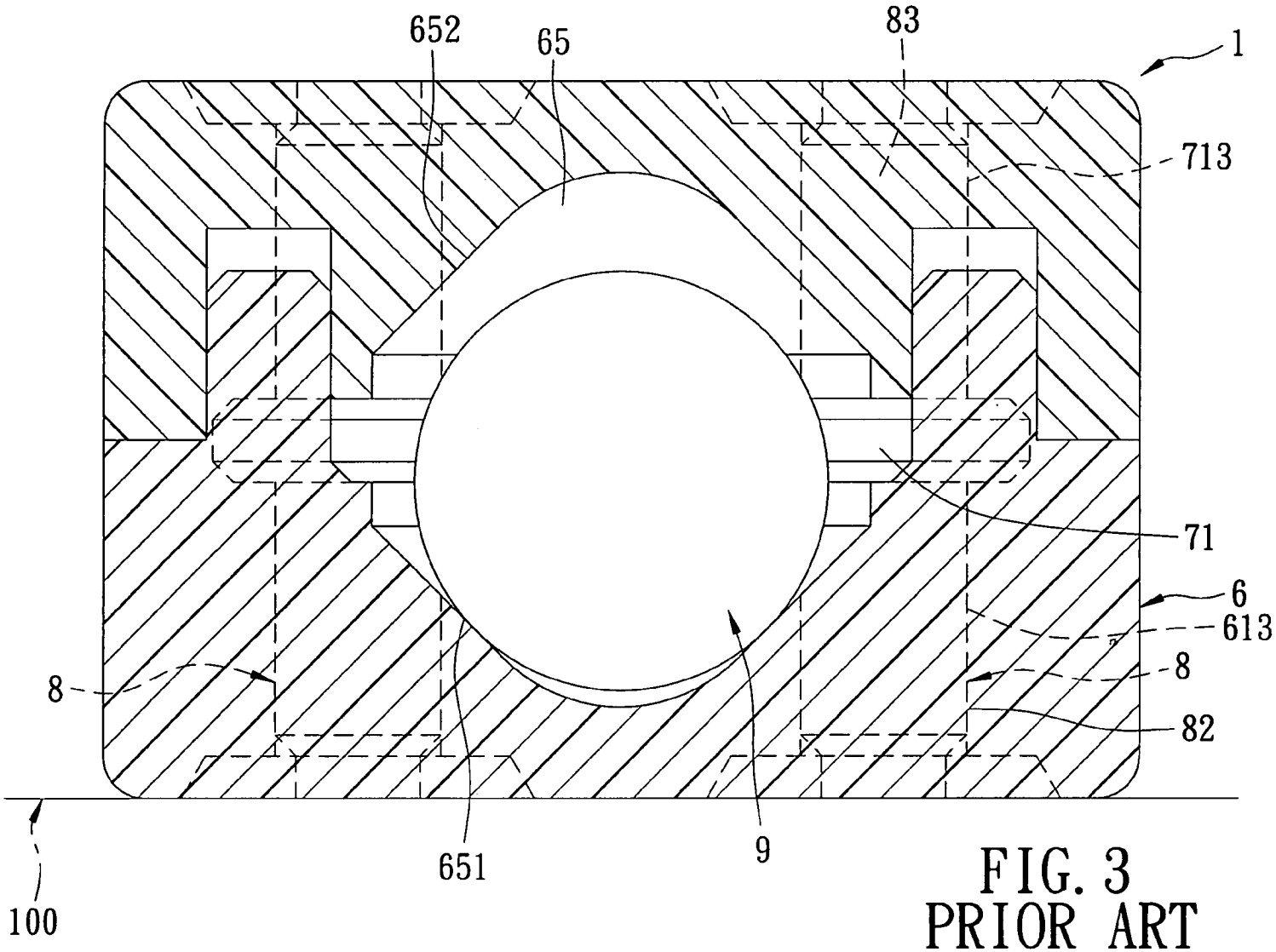
FIG. 3 PRIOR ART
FIG. 3 is an assembled sectional view of the switch of FIG. 1.
Figure 4:
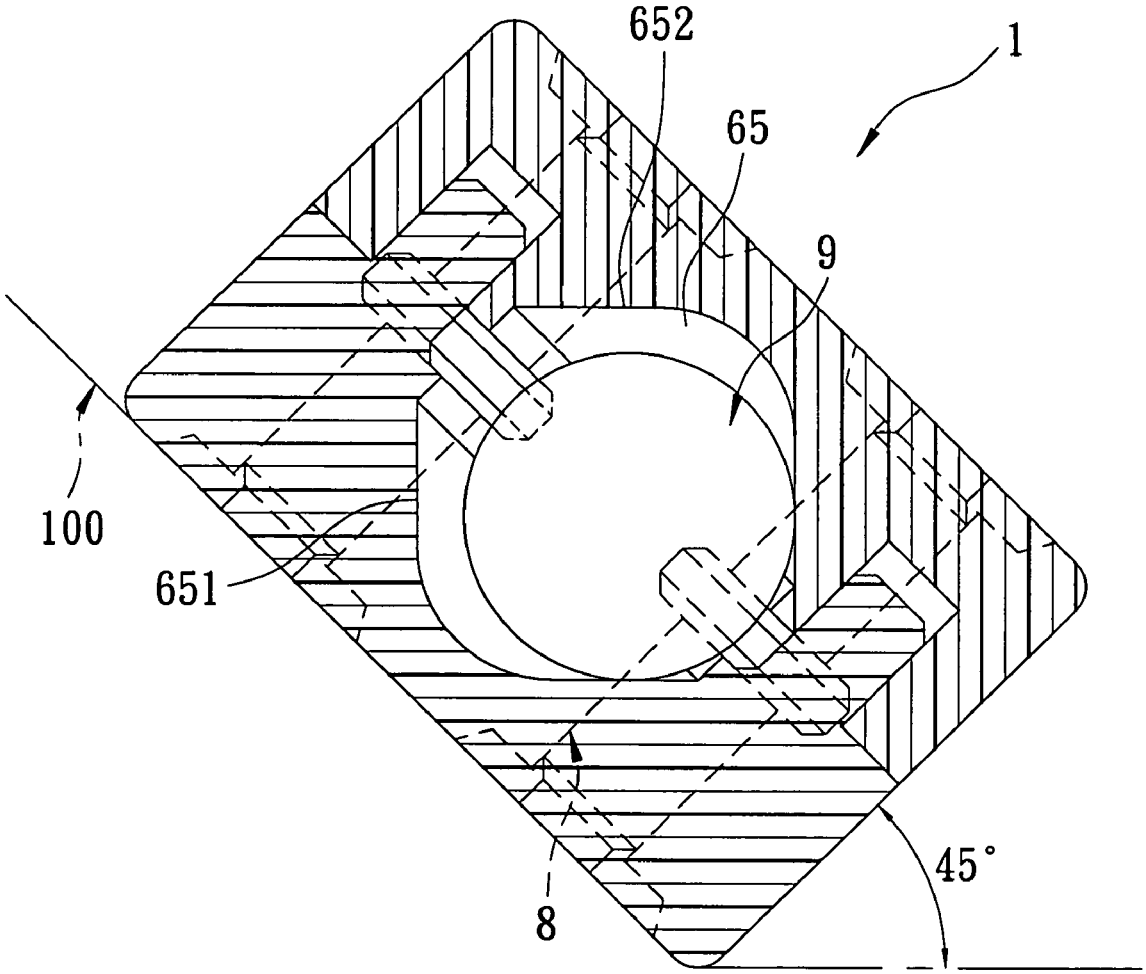
FIG. 4 PRIOR ART
FIG. 4 illustrates the switch of FIG. 1 in a state of use.
Figure 5:
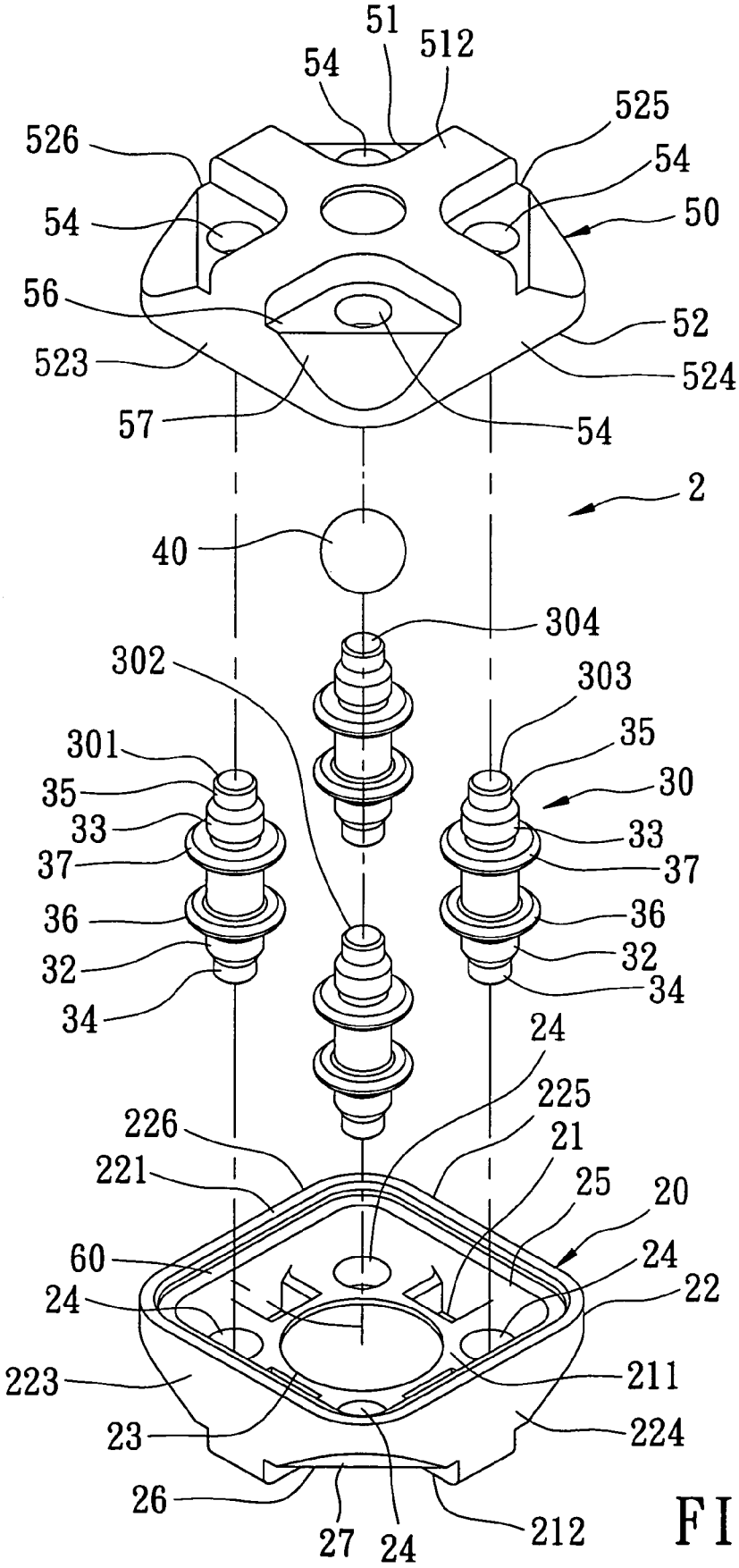
FIG. 5 is an exploded perspective view of the preferred embodiment of a switch according to the present invention.
Figure 6:
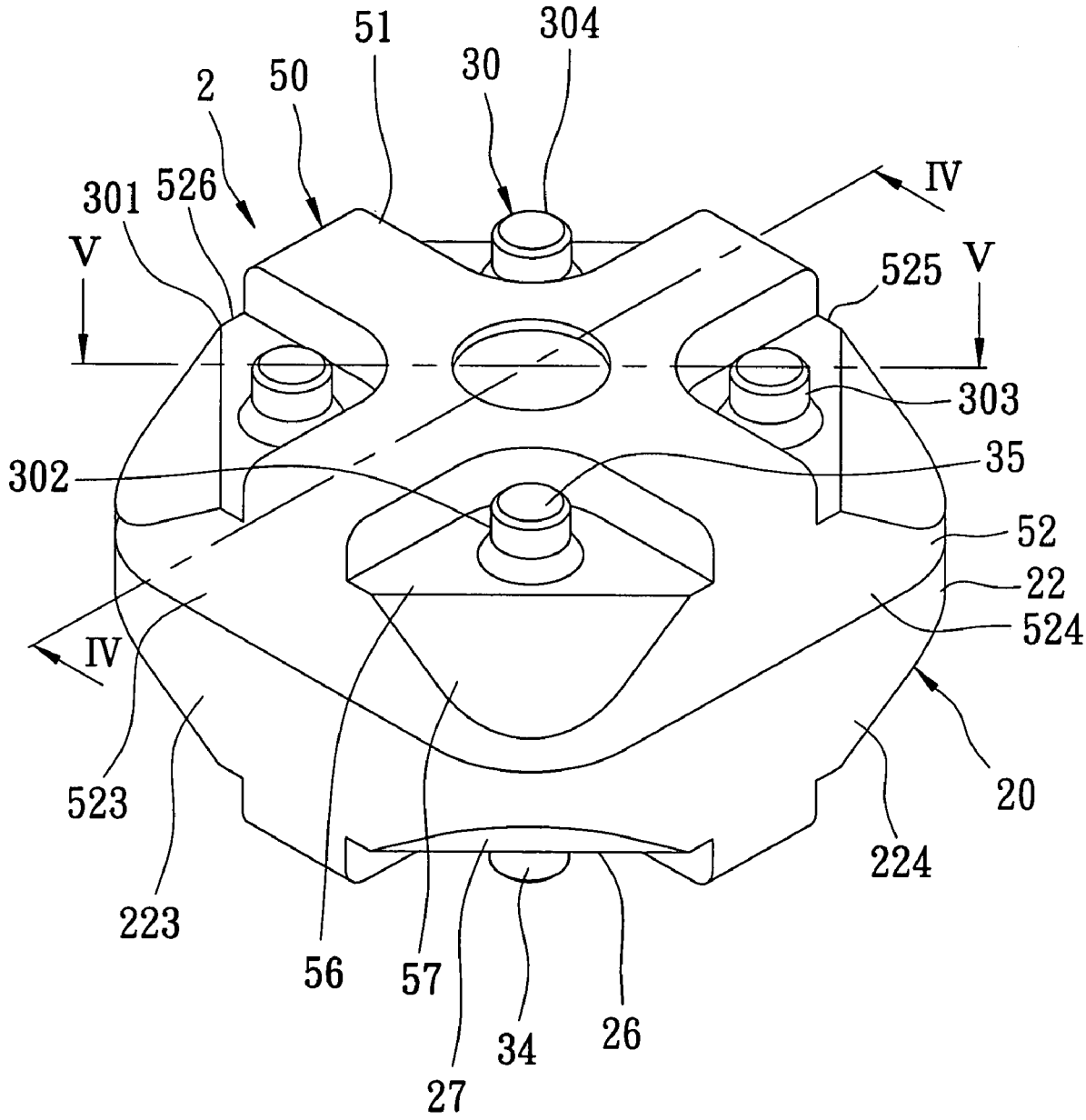
FIG. 6 is an assembled perspective view of the preferred embodiment.
Figure 7:
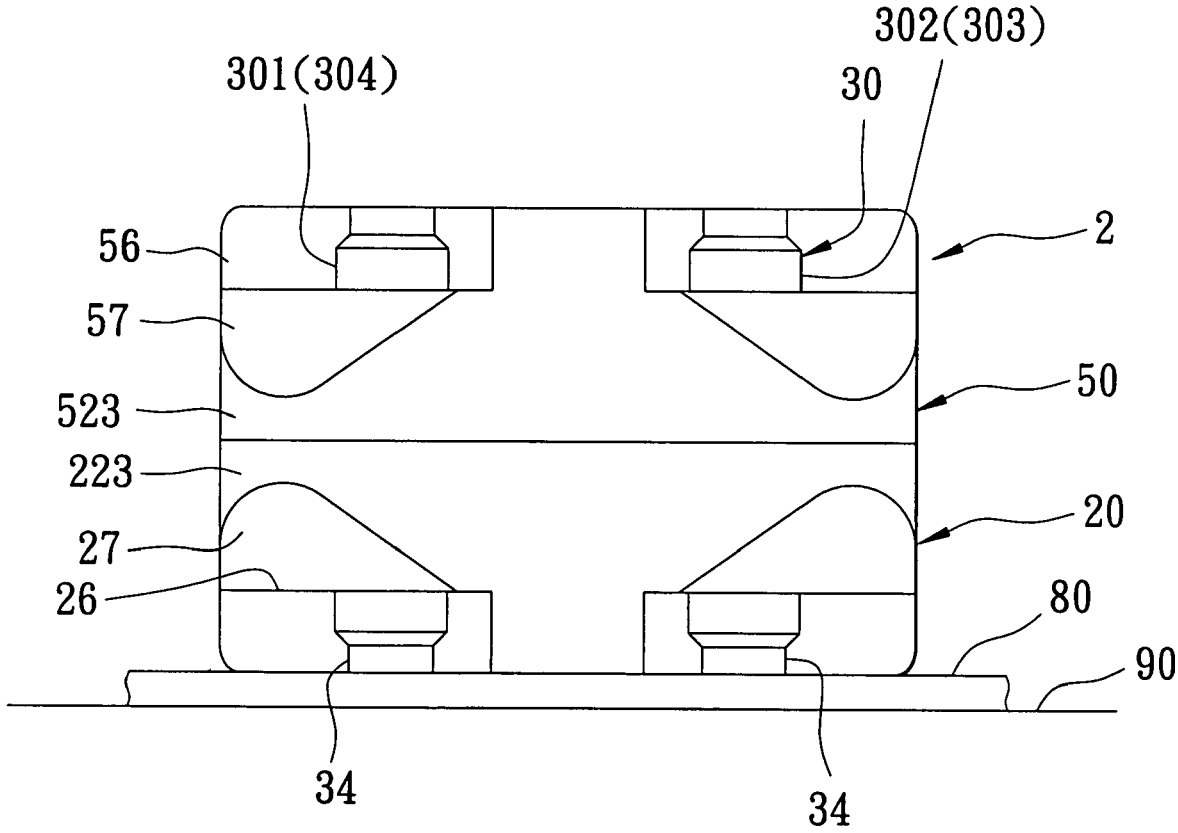
FIG. 7 is a schematic front view of the switch of the present invention in a state fixed on a circuit board.

Referring to FIGS. 5 to 7, the preferred embodiment of a switch 2 according to the present invention is shown to comprise a housing, a conductive terminal unit 30, and a conductive ball 40.

The housing defines a bottom receiving groove 23, a top receiving groove 53, and a chamber 25 between the top and bottom receiving grooves 53, 23. The housing includes a bottom seat 20, and a top cover 50 connected to the bottom seat 20.

The bottom seat 20 is made of an insulating material, such as plastic or rubber, and includes a bottom wall 21 having inner and outer wall faces 211, 212, a surrounding wall 22 extending upwardly from a peripheral end of the bottom wall 21, and a plurality of spaced-apart bottom through holes 24 extending through the inner and outer wall faces 211, 212. The bottom receiving groove 23 is formed in the inner wall face 211, and extends toward the outer wall face 212. The bottom receiving groove 23 is defined by a truncated cone-shaped wall 231, and a groove bottom 232 connected to the truncated cone-shaped wall 231. In this embodiment, the number of the bottom through holes 24 provided in the bottom seat 20 is four. The bottom through holes 24 surround the bottom receiving groove 23.

The surrounding wall 22 of the bottom seat 20 has a stepped top face 221, and first to fourth outer wall faces 223, 224, 225, 226.

Preferably, the bottom seat 20 further includes four spaced-apart bottom cutout portions 26 formed in the outer wall face 212 of the bottom wall 21 and communicating respectively with the bottom through holes 24, and four beveled corner faces 27 respectively adjacent to the bottom cutout portions 26.

The top cover 50 is made of an insulating material, and is similar in construction to the bottom seat 20. Particularly, the top cover 50 includes a top wall 51 having inner and outer wall faces 511, 512, a surrounding wall 52 extending downwardly from a peripheral end of the top wall 51, and four spaced-apart top through holes 54 extending through the inner and outer wall faces 511, 512.

The chamber 25 is formed between the inner wall faces 511, 211 of the top and bottom walls 51, 21 and within the surrounding walls 52, 22 of the top cover 50 and the bottom seat 20.

The top receiving groove 53 is formed in the inner wall face 511, and extends toward the outer wall face 512. The top receiving groove 53 is defined by a truncated cone-shaped wall 531, and a groove bottom 532 connected to the truncated cone-shaped wall 531. The truncated cone-shaped walls 531, 231 of the top and bottom receiving grooves 53, 23 define a co-axis 60 that passes through the chamber 25. The top through holes 54 surround the top receiving groove 53.

The surrounding wall 52 of the top cover 50 includes a stepped bottom face 521 that complements the stepped top face 221 to facilitate joining of the top cover 50 and the bottom seat 20, and first to fourth outer wall faces 523, 524, 525, 526.

Preferably, the top cover 50 further includes four spaced-apart top cutout portions 56 formed in the outer wall face 512 and communicating respectively with the top through holes 54, and four beveled corner faces 57 respectively adjacent to the top cutout portions 56.

In this embodiment, the conductive terminal unit 30 includes first to fourth terminal rods 301, 302, 303, 304 mounted on the housing around the co-axis 60 in an angularly spaced apart manner and extending through the chamber 25. The first to fourth terminal rods 301, 302, 303, 304 have top and bottom end portions. The top end portions of the first to fourth terminal rods 301, 302, 303, 304 have top insert parts 33 respectively inserted into the top through holes 54, and top connecting ends 35 extending outwardly and respectively from the top insert parts 33 and extending respectively into the top cutout portions 56 through the top through holes 54. The bottom end portions of the first to fourth terminal rods 301, 302, 303, 304 have bottom insert parts 32 respectively inserted into the bottom through holes 24, and bottom connecting ends 34 extending outwardly and respectively from the bottom insert parts 32 and extending respectively into the bottom cutout portions 26 through the bottom through holes 24 so as to be welded to a circuit board 80. Welding conditions of the bottom connecting ends 34 to the circuit board 80 can be checked easily through the beveled corner faces 27.

Each of the first to fourth terminal rods 301, 302, 303, 304 further has a top transverse flange 37 proximate to the top insert part 33 of the corresponding terminal rod 301, 302, 303, 304, and a bottom transverse flange 36 proximate to the bottom insert part 32 of the corresponding terminal rod 301, 302, 303, 304. The top and bottom transverse flanges 37, 36 of each of the first to fourth terminal rods 301, 302, 303, 304 are disposed between the top and bottom receiving grooves 53, 23.

The conductive ball 40 is disposed inside the housing, and is movable from the chamber 25 to the top or bottom receiving groove 53, 23 and vice versa. The conductive ball 40 contacts, and therefore bridges, only two adjacent ones of the terminal rods 301, 302, 303, 304 when the switch 2 is in an ON position, and moves into the top or bottom receiving groove 53, 23 when the switch 2 is in an OFF position.

When the top cover 50 covers the bottom seat 20, the stepped bottom face 521 of the top cover 50 is exactly seated on the stepped top face 221 of the bottom seat 20, and the top connecting ends 35 of the terminal rods 301, 302, 303, 304 extend respectively through the top through holes 54 and into the top cutout portions 56 so as to be welded to an article (not shown). The surrounding walls 52, 22 of the top cover 50 and the bottom seat 20 are then connected to each other by a high frequency sealing technique. Consequently, the top transverse flanges 37 of the terminal rods 301, 302, 303, 304 abut against the inner wall face 511 of the top wall 51, while the bottom transverse flanges 36 of the terminal rods 301, 302, 303, 304 abut against the inner wall face 211 of the bottom wall 21.

With reference to FIGS. 5 to 7, when the bottom connecting ends 34 of the terminal rods 301, 302, 303, 304 are welded to the circuit board 80, and the circuit board 80 is horizontal relative to a reference horizontal surface 90, the conductive ball 40 is located in the bottom receiving groove 23, and is not in contact with any of the terminal rods 301, 302, 303, 304, so that the switch 2 is in an "OFF" state at this time.

Figure 12:
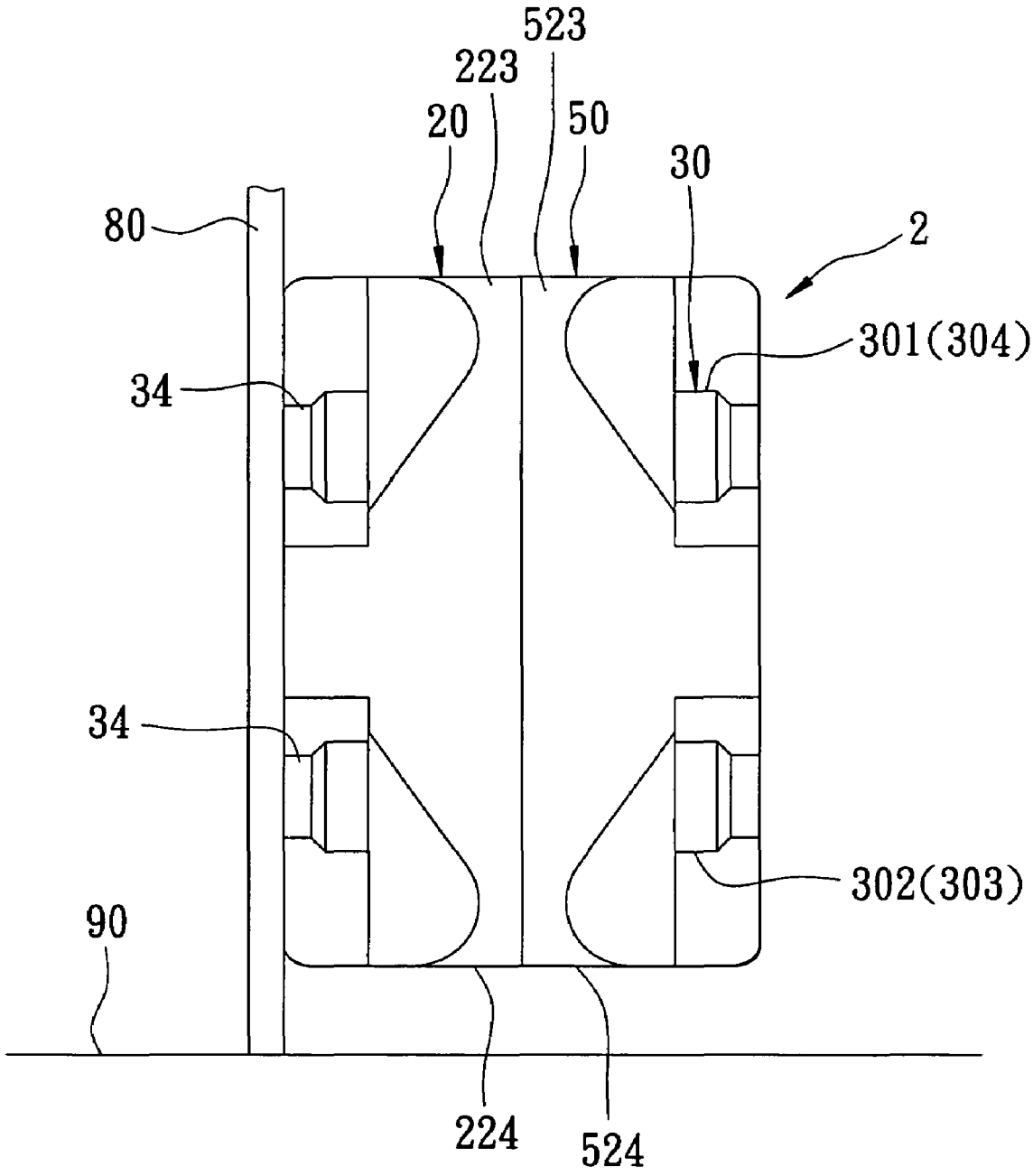
FIG. 12 is a view similar to FIG. 7, but with the switch of the present invention together with the circuit board in a vertical position.
Figure 13:
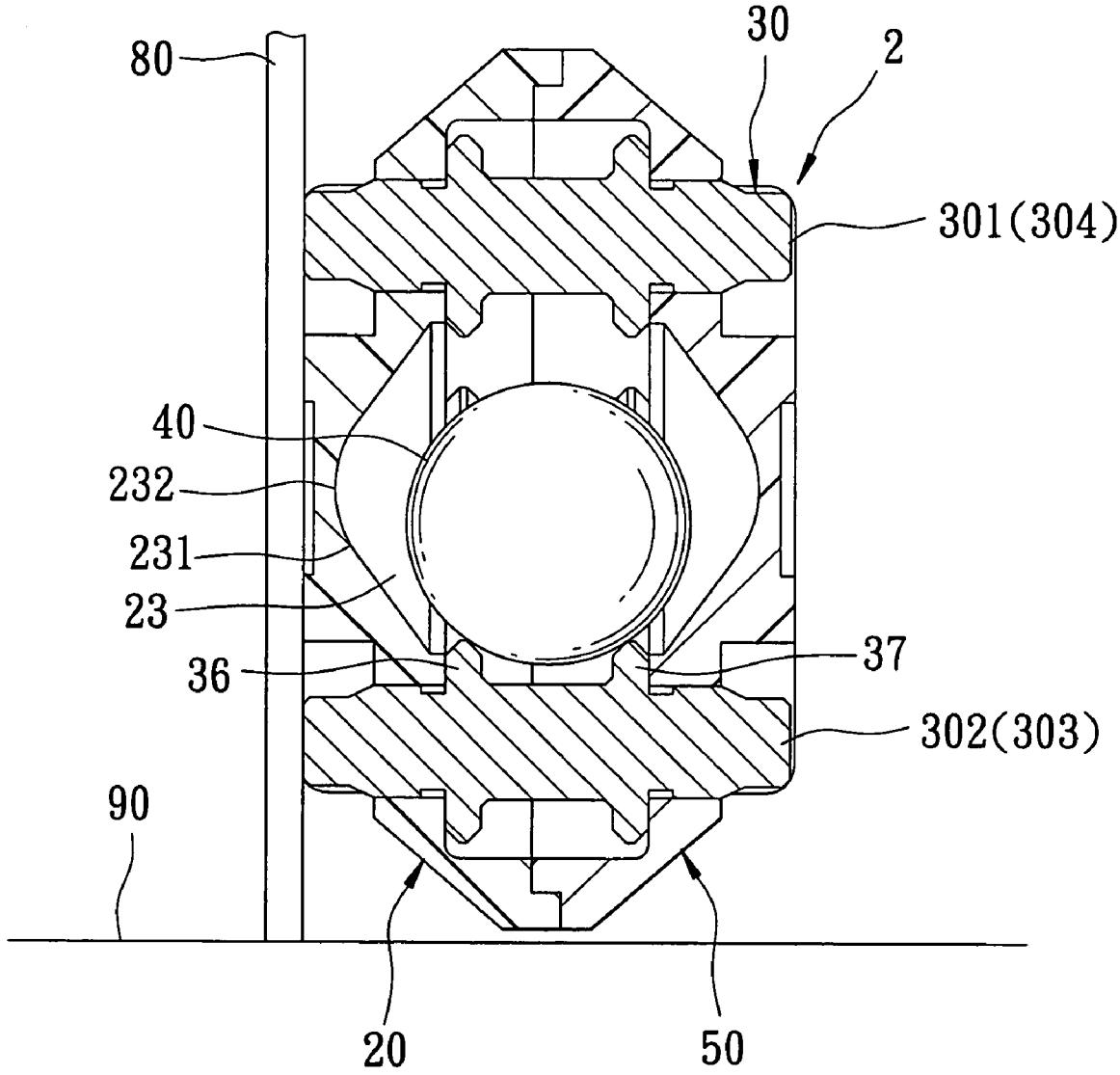
FIG. 13 is a sectional view of FIG. 12.

Referring to FIGS. 12 and 13, when the switch 2 is turned such that the circuit board 80 is vertical relative to the reference horizontal surface 90 and the second outer wall faces 224, 524 of the surrounding walls 22, 52 of the bottom seat 20 and the top cover 50 are horizontal relative to the reference horizontal surface 90, the conductive ball 40 rolls to contact the top and bottom transverse flanges 37, 36 of the second and third terminal rods 302, 303, thereby switching the switch 2 to an "ON" state.

Figure 8:
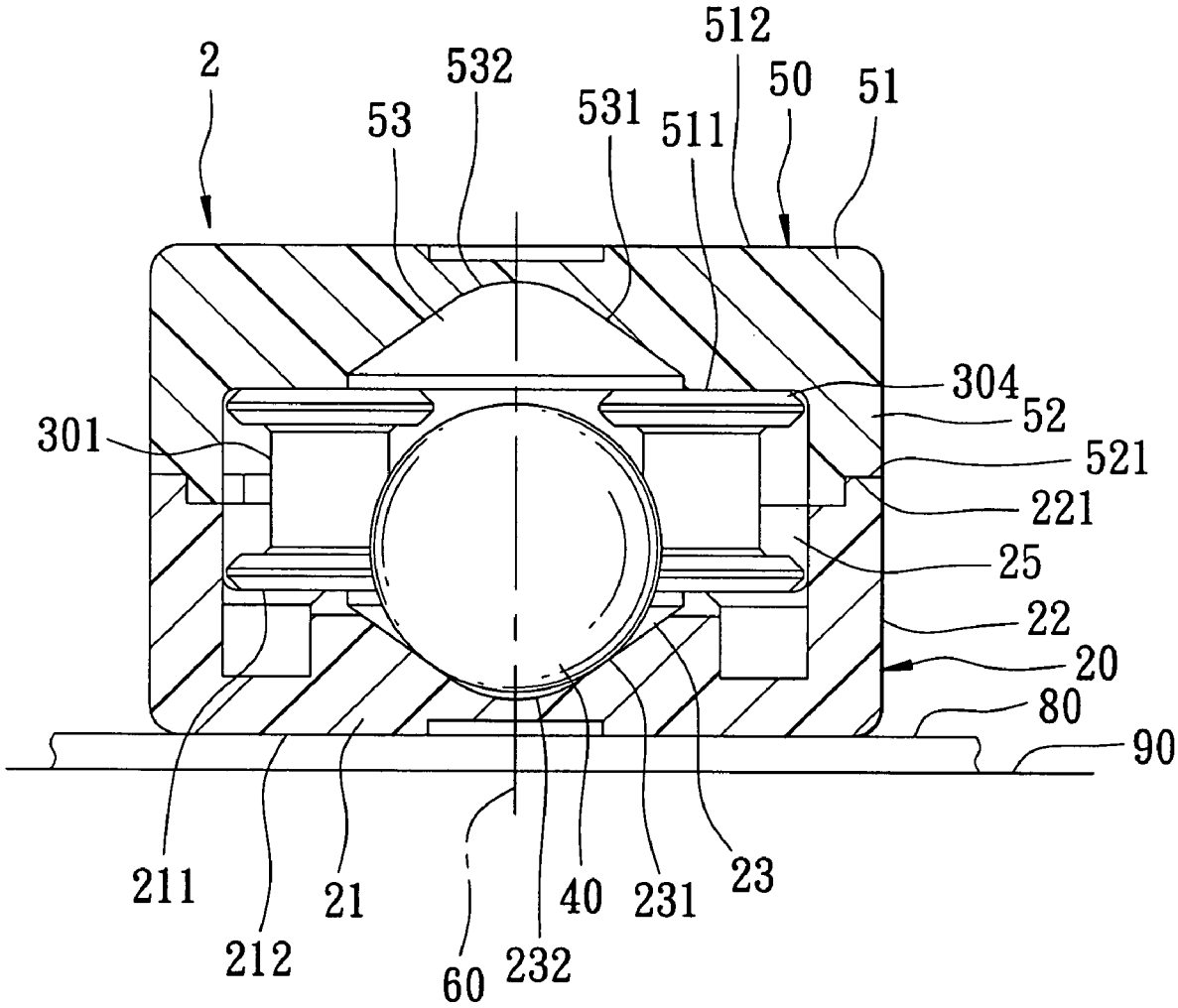
FIG. 8 is a sectional view of the preferred embodiment taken along line IV-IV of FIG. 6.
Figure 9:
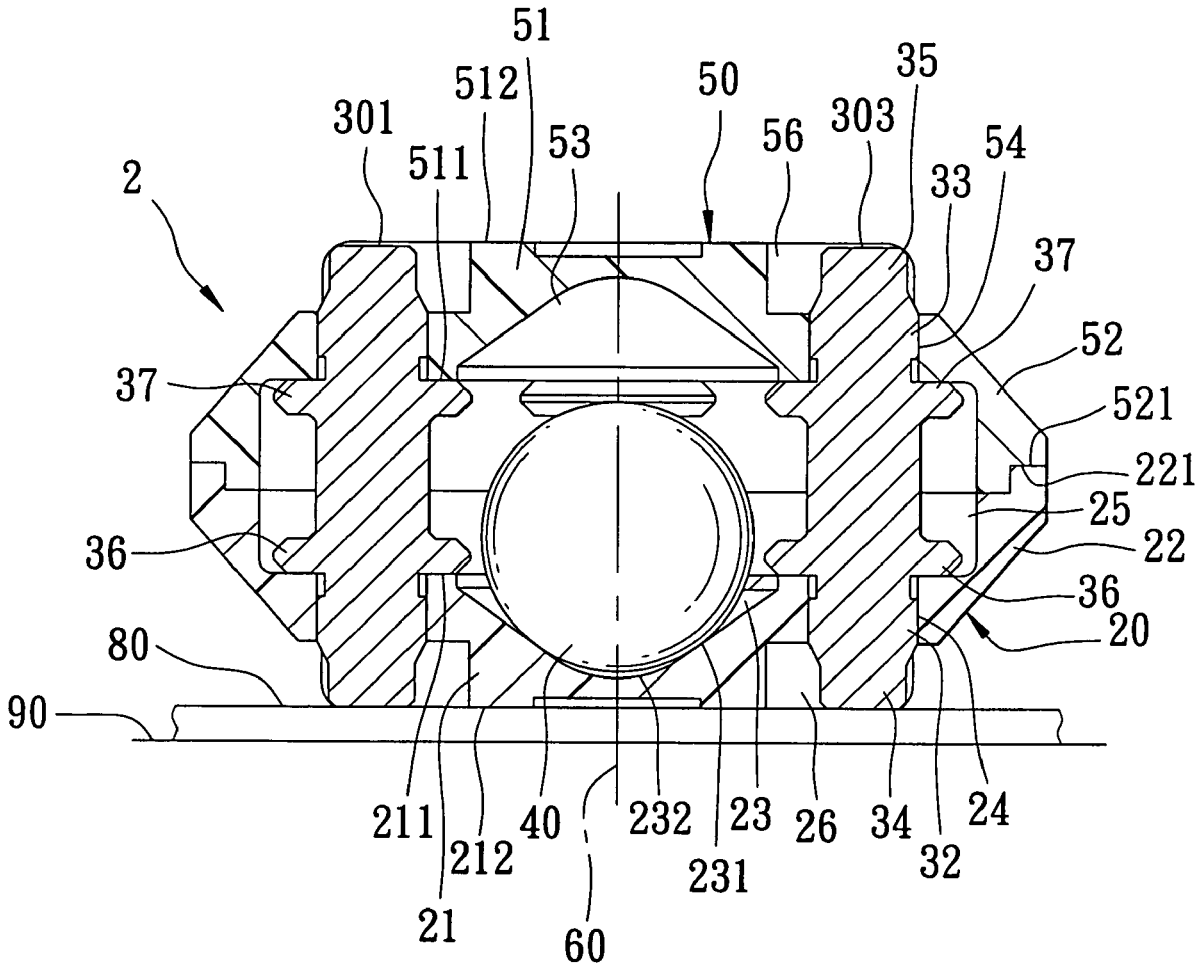
FIG. 9 is a sectional view of the preferred embodiment taken along line V-V of FIG. 6.
Figure 10:
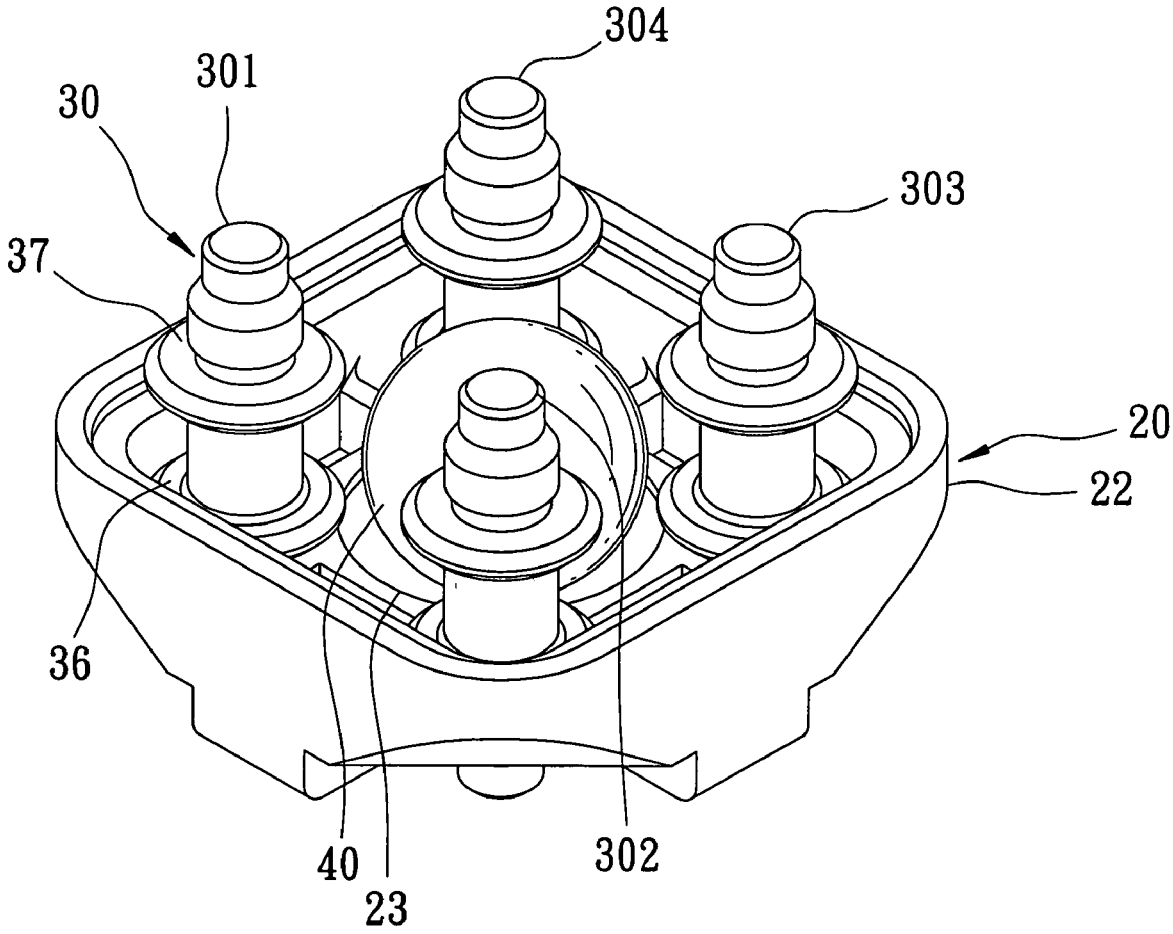
FIG. 10 is a perspective view of the preferred embodiment with a top cover removed for the sake of clarity.
Figure 11:
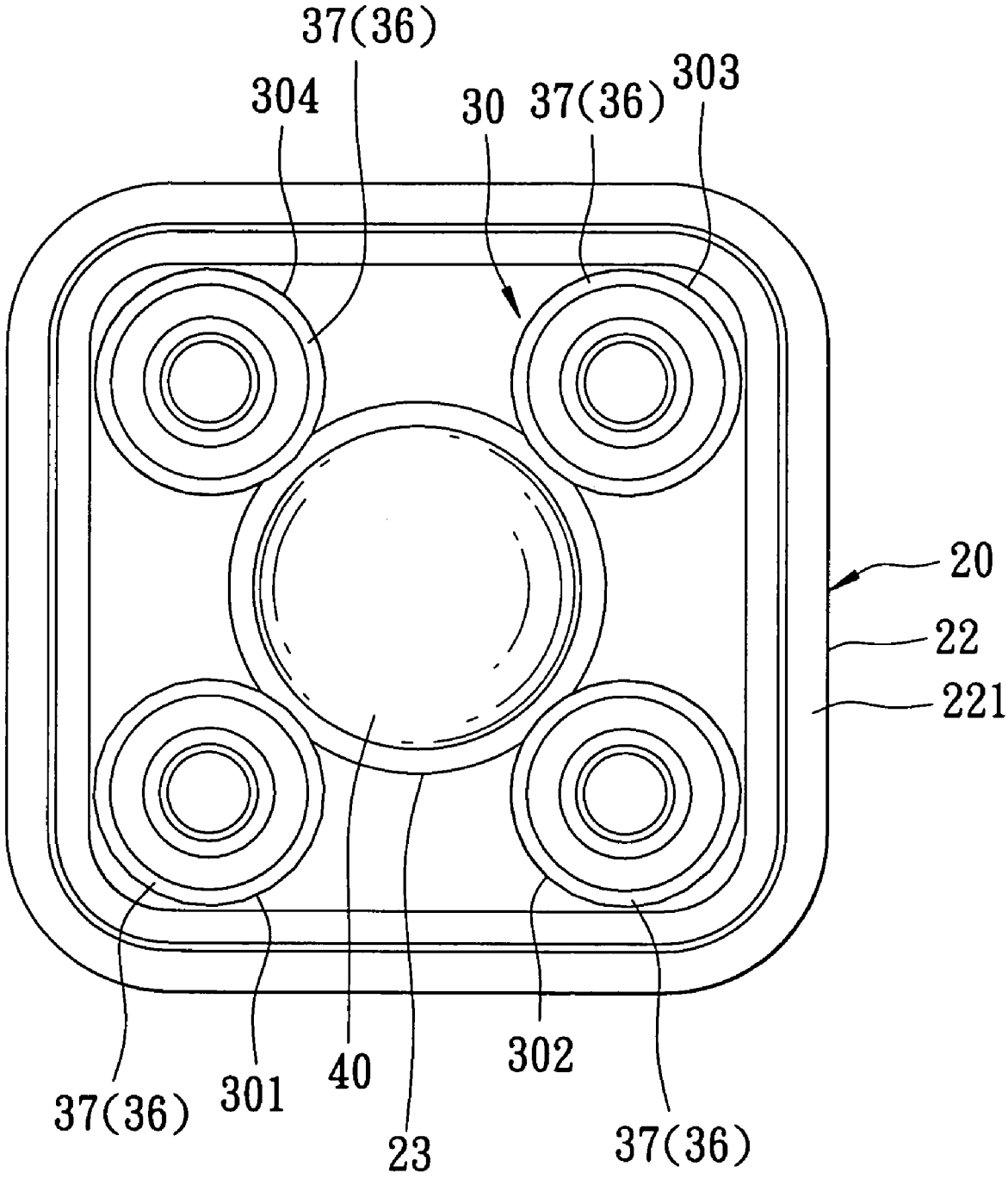
FIG. 11 is a schematic top view of FIG. 6.

When the switch 2 is rotated from the position shown in FIG. 8 to the positions shown in FIG. 13, the conductive ball 40 changes position as shown in FIGS. 11 to 14.

In particular, when the switch 2 is rotated so that the third outer wall faces 225, 525 of the surrounding walls 22, 52 of the bottom seat 20 and the top cover 50 are turned to a horizontal position shown in FIG. 12, the conductive ball 40 rolls to contact the top and bottom transverse flanges 37, 36 of the third and fourth terminal rods 303, 304, so that the switch 2 is maintained in the "ON" state.

When the switch 2 is rotated so that the fourth outer wall faces 226, 526 of the surrounding walls 22, 52 of the bottom seat 20 and the top cover 50 are turned to a horizontal position shown in FIG. 13, the conductive ball 40 rolls to contact the top and bottom transverse flanges 37, 36 of the fourth and first terminal rods 304, 301, so that the switch 2 is similarly maintained in the "ON" state.

Figure 14:
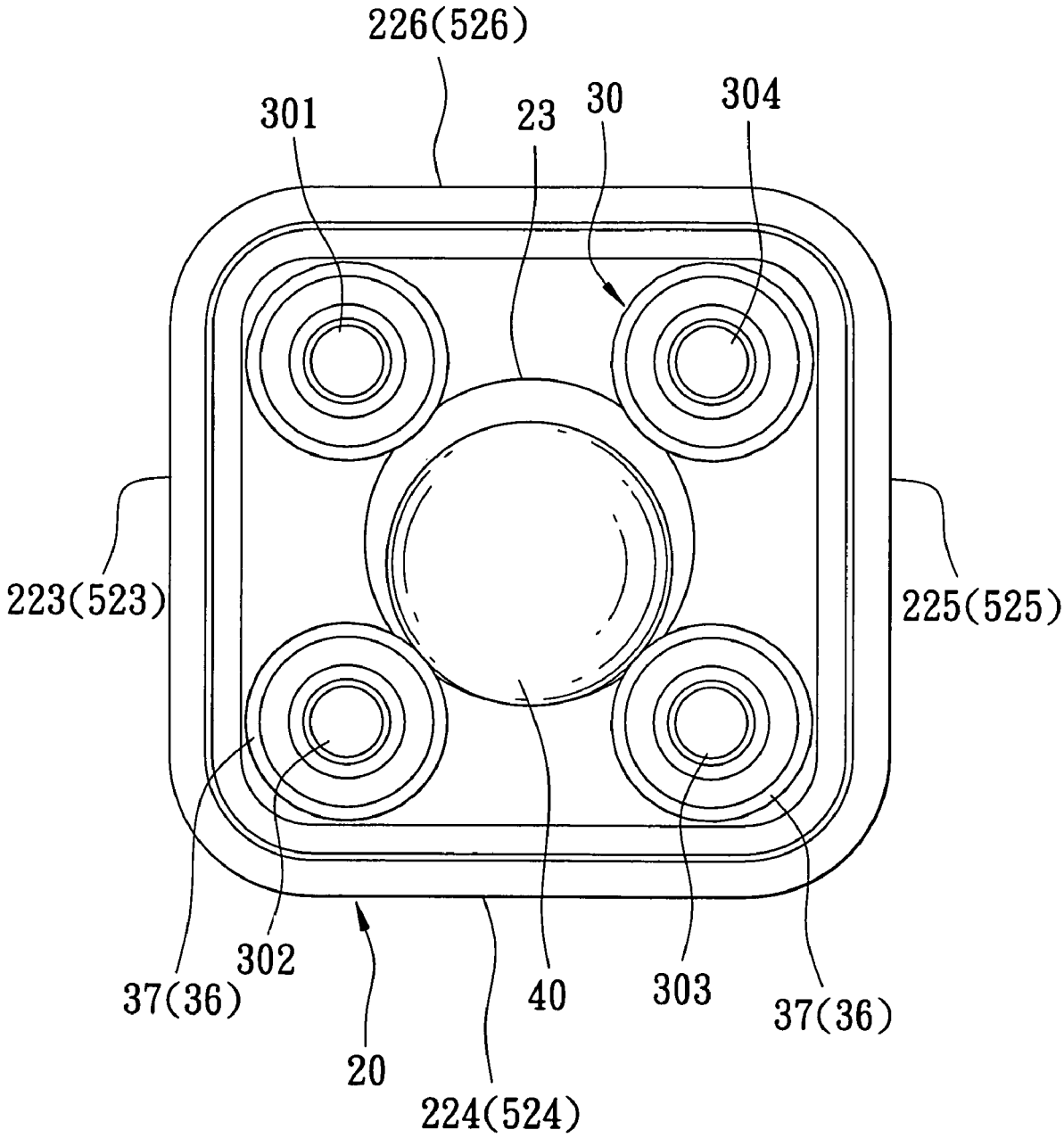
FIG. 14 is a schematic top view of FIG. 9, with top cover removed.
Figure 15:
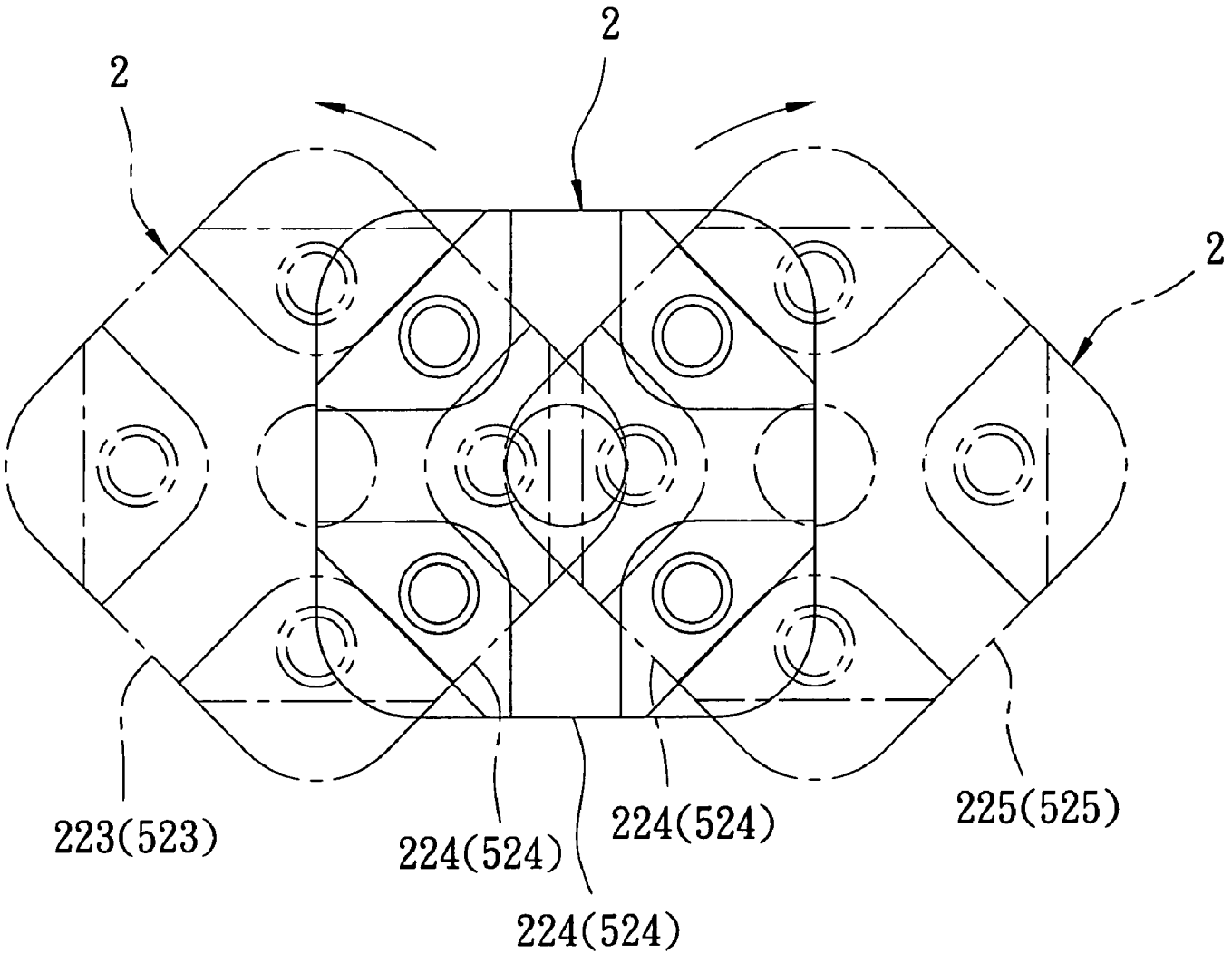
FIG. 15 illustrates the switch of the present invention when rotated.
Figure 16:
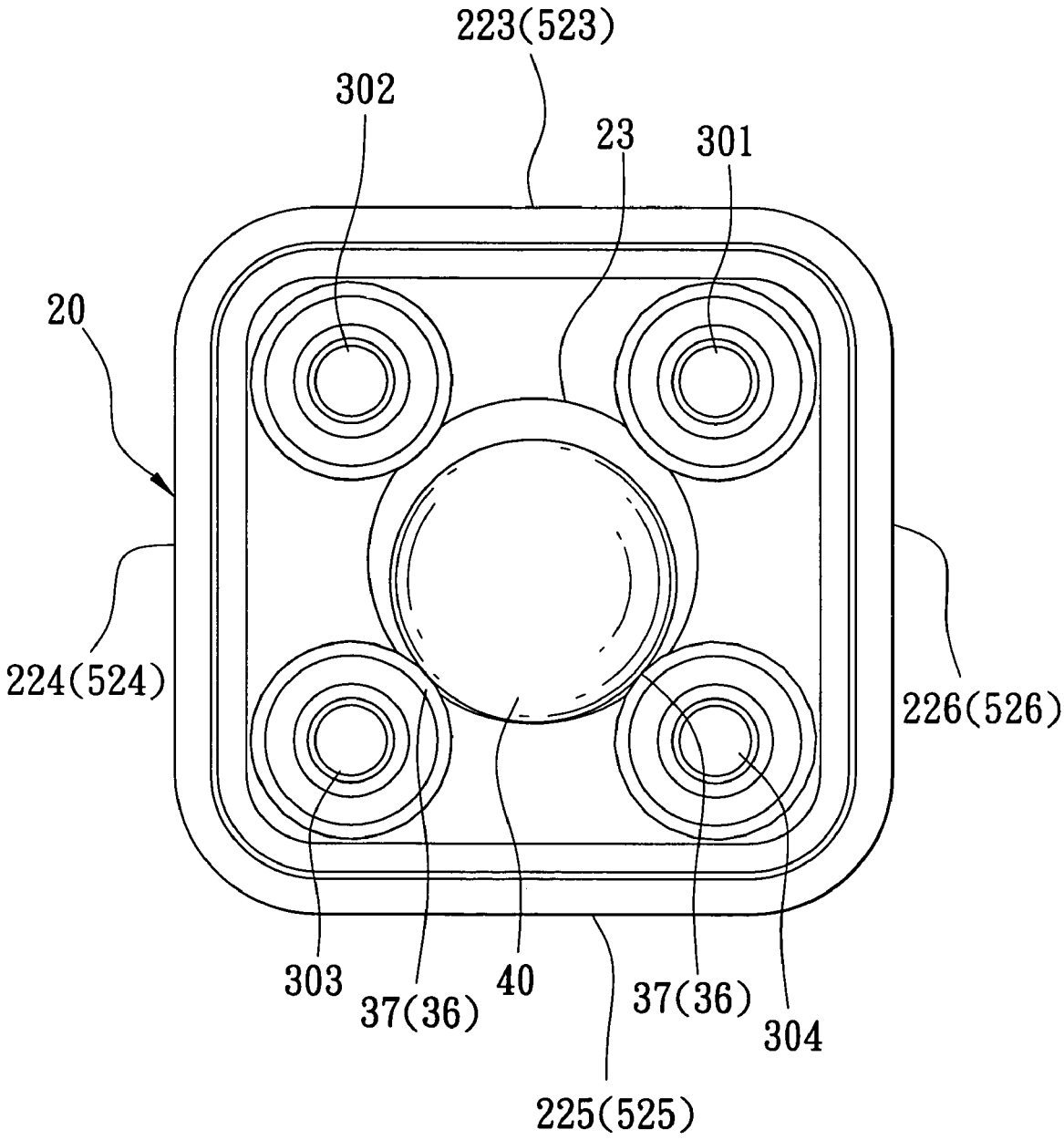
FIG. 16 is a view similar to FIG. 11, but with the conductive ball in contact with third and fourth terminal rods.
Figure 17:
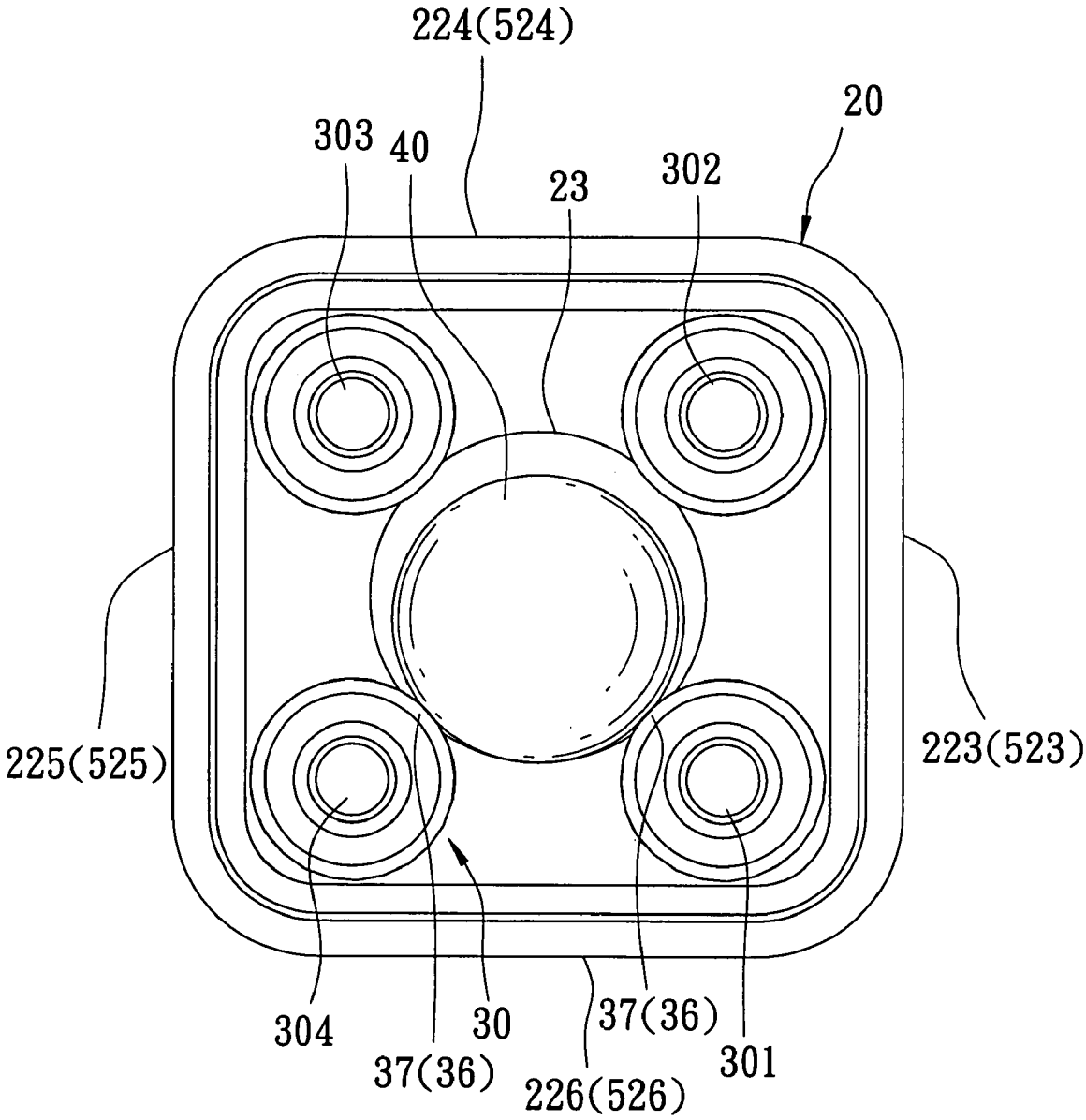
FIG. 17 is a view similar to FIG. 11, but with the conductive ball in contact with first and fourth terminal rods.
Figure 18:
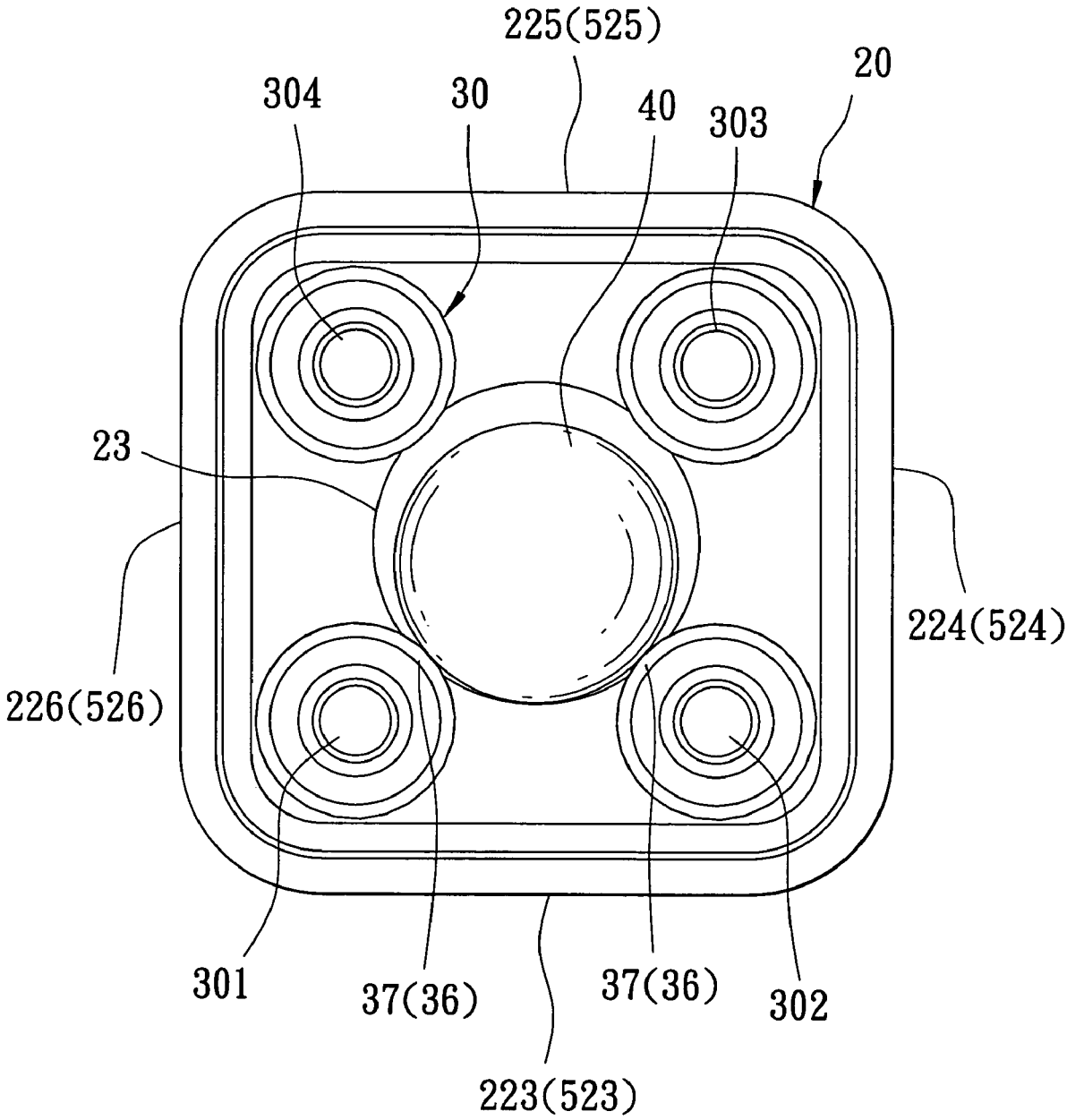
FIG. 18 is a view similar to FIG. 11, but with the conductive ball in contact with first and second terminal rods.

When the switch 2 is rotated so that the first outer wall faces 223, 523 of the surrounding walls 22, 52 of the bottom seat 20 and the top cover 50 are turned to a horizontal position shown in FIG. 14, the conductive ball 40 rolls to contact the top and bottom transverse flanges 37, 36 of the first and second terminal rods 301, 302, so that the switch 2 is maintained in the "ON" state.

As each terminal rod 301, 302, 303, 304 has top and bottom transverse flanges 37, 36, the conductive ball 40 can bridge and contact two of the top flanges 37 and two of the bottom flanges 36 when the switch 2 is in the ON state. If the switch 2 rotates about an axis parallel to the terminal rods 301, 302, 303, 304, the conductive ball 40 will slide on the top and bottom flanges 37, 36 stably, and will not move into the top and bottom receiving grooves 53, 23 easily. As such, the switch 2 can be set to the ON state constantly and stably when the switch 2 rotates continuously.

From the aforementioned description, it is apparent that when the switch 2 is mounted vertically or turned, the conductive ball 40 can quickly contact the top and bottom transverse flanges 37, 36 of any two adjacent ones of the terminal rods 301, 302, 303, 304 so as to switch the switch 2 from the "OFF" state to the "ON" state. Hence, the switch 2 of the present invention has a high sensitivity, thereby making the switch 2 suitable for application to the circuit board 80 for providing triggering signals and detecting a position of an electronic product.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A switch comprising:

a housing defining a bottom receiving groove, a top receiving groove, and a chamber between said top and bottom receiving grooves, each of said top and bottom receiving grooves being defined by a truncated cone-shaped wall, and a groove bottom connected to said truncated cone-shaped wall, said truncated cone-shaped walls of said top and bottom receiving grooves defining a co-axis that passes through said chamber;

a plurality of terminal rods mounted on said housing around said co-axis in an angularly spaced apart manner and extending through said chamber, said terminal rods having top end portions disposed around said top receiving groove, and bottom end portions disposed around said bottom receiving groove, each of said terminal rods further having spaced-apart top and bottom transverse flanges disposed between said top and bottom receiving grooves; and a conductive ball disposed inside said housing and movable from said chamber to said top or bottom receiving groove and vice versa, said conductive ball contacting two adjacent ones of said terminal rods by bridging said top and bottom transverse flanges of said two adjacent ones of said terminal rods when said switch is in an ON position, said conductive ball moving into said top or bottom receiving groove when said switch is in an OFF position.

2. The switch of claim 1, wherein said housing includes a bottom seat and a top cover connected to said bottom seat, said bottom seat including a bottom wall having inner and outer wall faces, said bottom receiving groove being formed in said inner wall face and extending toward said outer wall face, said bottom seat further including a surrounding wall extending upwardly from a peripheral end of said bottom wall, and a plurality of spaced-apart bottom through holes extending through said inner and outer wall faces of said bottom wall and surrounding said bottom receiving groove, said top cover including a top wall having inner and outer wall faces, said top receiving groove being formed in said inner wall face of said top wall and extending toward said outer wall face of said top wall, said top cover further including a surrounding wall extending downwardly from a peripheral end of said top wall, and a plurality of spaced-apart top through holes extending through said inner and outer wall faces of said top wall and surrounding said top receiving groove, said chamber being formed between said inner wall faces of said top and bottom walls and within said surrounding walls of said top cover and said bottom seat.

3. The switch of claim 2, wherein the number of said terminal rods is four, said top through holes receiving respectively said top end portions of said terminal rods, said bottom through holes receiving respectively said bottom end portions of said terminal rods.

4. The switch of claim 3, wherein said top end portions of said terminal rods have top insert parts respectively inserted into said top through holes, and said bottom end portions of said terminal rods have bottom insert parts respectively inserted into said bottom through holes.

5. The switch of claim 4, wherein said top cover further includes four spaced-apart top cutout portions formed in said outer wall face of said top wall and communicating respectively with said top through holes, said bottom seat further including four spaced-apart bottom cutout portions formed in said outer wall face of said bottom wall and communicating respectively with said bottom through holes, said top end portions of said terminal rods further including top connecting ends extending outwardly and respectively from said top insert parts and extending respectively into said top cutout portions through said top through holes, said bottom end portions of said terminal rods further including bottom connecting ends extending outwardly and respectively from said bottom insert parts and extending respectively into said bottom cutout portions through said bottom through holes.

6. The switch of claim 5, wherein said bottom seat further includes four beveled corner faces respectively adjacent to said bottom cutout portions.

7. The switch of claim 2, wherein said surrounding wall of said top cover has a stepped bottom face, and said surrounding wall of said bottom seat has a stepped top face to be fitted snugly to said stepped bottom face.

* * * * *